US007783482B2

(12) United States Patent
Janiszewski et al.

(10) Patent No.: US 7,783,482 B2
(45) Date of Patent: Aug. 24, 2010

(54) METHOD AND APPARATUS FOR ENHANCING VOICE INTELLIGIBILITY IN VOICE-OVER-IP NETWORK APPLICATIONS WITH LATE ARRIVING PACKETS

(75) Inventors: Thomas John Janiszewski, Andover, NJ (US); Minkyu Lee, Ringoes, NJ (US); James William McGowan, Whitehouse Station, NJ (US); Michael Charles Recchione, Nutley, NJ (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 1674 days.

(21) Appl. No.: 10/948,933

(22) Filed: Sep. 24, 2004

(65) Prior Publication Data

US 2006/0074681 A1 Apr. 6, 2006

(51) Int. Cl.
*G10L 21/02* (2006.01)

(52) U.S. Cl. ..... 704/228

(58) Field of Classification Search ..... 704/228
See application file for complete search history.

(56) References Cited

U.S. PATENT DOCUMENTS

| | | | | |
|---|---|---|---|---|
| 4,726,019 | A * | 2/1988 | Adelmann et al. | 370/474 |
| 6,366,959 | B1 * | 4/2002 | Sidhu et al. | 709/231 |
| 6,744,764 | B1 * | 6/2004 | Bigdeliazari et al. | 370/394 |
| 6,850,496 | B1 * | 2/2005 | Knappe et al. | 370/260 |
| 7,324,444 | B1 * | 1/2008 | Liang et al. | 370/230 |
| 7,337,108 | B2 * | 2/2008 | Florencio et al. | 704/208 |
| 7,447,983 | B2 * | 11/2008 | Conway | 714/795 |
| 2003/0152093 | A1 * | 8/2003 | Gupta et al. | 370/412 |
| 2004/0047369 | A1 * | 3/2004 | Goel | 370/516 |
| 2004/0081106 | A1 * | 4/2004 | Bruhn | 370/276 |
| 2004/0120309 | A1 * | 6/2004 | Kurittu et al. | 370/352 |
| 2005/0010401 | A1 * | 1/2005 | Sung et al. | 704/219 |
| 2005/0243846 | A1 * | 11/2005 | Mallila | 370/412 |

OTHER PUBLICATIONS

Liang et al., Adaptive playout scheduling and loss concealment for voice communication over IP networks 2003, IEEE, vol. 5, pp. 532-542.*

P. Gournay, F. Rousseau and R. Lefebvre, *"Improved packet loss recovery using late frames for prediction-based speech coders,"* Proceedings of ICASSP 2003, Hong Kong, Apr. 6-10, 2003.

ITU-T (International Telecommunication Union Standardization Sector) G.711 Appendix I: *"A high quality low-complexity algorithm for packet loss concealment with G.711,"* Sep. 1999.

* cited by examiner

*Primary Examiner*—Jakieda R Jackson
(74) *Attorney, Agent, or Firm*—Kenneth M. Brown

(57) ABSTRACT

A method and apparatus for enhancing voice intelligibility for network communications of speech such as, for example, VoIP (Voice-Over-Internet-Protocol), in the presence of packets which arrive too late for normal playout. When a late speech packet is received by a speech decoder, that packet and, if necessary, one or more additional packets subsequent thereto, are played out over a shorter than normal duration so that the decoder can "catch up" with the encoder. Since a voice frame is usually decoded in several sub-frames—typically two or three—this shortened playout may be achieved, for example, by skipping one sub-frame from each frame to be shortened.

20 Claims, 2 Drawing Sheets

METHOD AND APPARATUS FOR ENHANCING VOICE INTELLIGIBILITY IN VOICE-OVER-IP NETWORK APPLICATIONS WITH LATE ARRIVING PACKETS

FIELD OF THE INVENTION

The present invention relates generally to packet-based communications networks and more particularly to a method and apparatus for enhancing voice intelligibility for telecommunications technologies such as VoIP (Voice-Over-Internet-Protocol) in general, and wireless VoIP in particular, in the presence of packets which arrive too late for normal playout.

BACKGROUND OF THE INVENTION

The telecommunications industry in North America and Europe is currently preparing the launch of "3G" (third generation) wireless technologies from both the CDMA and GMS worlds. (CDMA and GMS are wireless communication standards fully familiar to those of ordinary skill in the art.) On the CDMA side, the CDMA1xEvDO (also familiar to those skilled in the art) can provide wireless data connections that are ten times as fast as a regular modem. However, as the name EvDO (Evolution Data Only or Evolution Data Optimized) implies, voice traffic is still routed through 3G1xCS channels. Naturally, the next step is to move voice traffic over IP on wireless high-speed packet channels.

In order to achieve high quality VoIP (Voice over IP) on wireless packet channels, there are many challenges ahead. IP overhead is typically quite large relative to speech payload information. The typical end-to-end delay across a typical communications network needs to be reduced. One way of reducing such end-to-end delay is to minimize the jitter buffer playback delay at the decoder. Unfortunately, one direct effect of minimizing the jitter buffer playback delay is an associated increase of the packet loss rate due to packets that arrive late.

When one or more packets arrive late at the receiving end for playout, a conventional decoder simply discards the late packets, since the decoder has already provided replacement material in accordance with a packet loss concealment (PLC) scheme. (As is well known to those of ordinary skill in the art, PLC schemes are used by most speech decoders in response to lost packets. These schemes use various techniques to attempt to minimize the deleterious effects of missing the speech signal encoded in the lost packet, but most commonly, they use some sort of packet repetition scheme in which the previous packet, possibly modified, is repeated in place of the lost packet.)

In one prior art technique for use with prediction-based speech coders, however, some improvement over conventional decoders has been obtained by utilizing the late packets for purposes of re-synchronizing the decoder, so that the error resulting from the late packet (actually the error resulting from the replacement packet in accordance with the PLR scheme) does not adversely propagate. Such an approach can significantly improve the voice quality over conventional schemes. However, even with use of this re-synchronizing scheme, the late packets are never actually played out, which means that a part of the sound may be missing. This can lead to a potential intelligibility problem. For example, if packets carrying the phoneme "s" from the word "spy" are lost, the resultant speech may end up sounding like "pie" rather than "spy." A PLC scheme alone, even with re-synchronization of the decoder using late packets, is unlikely to be able to rectify such a problem.

SUMMARY OF THE INVENTION

In accordance with the principles of the present invention, a method and apparatus for enhancing voice intelligibility for network communications of speech such as, for example, VoIP (Voice-Over-Internet-Protocol), in the presence of packets which arrive too late for normal playout is provided. Specifically, according to the principles of the present invention, when a late speech packet is received by a speech decoder, that packet and, if necessary, one or more additional packets subsequent thereto, are played out at a shorter than normal time scale so that the decoder can "catch up" with the encoder. Moreover, this is advantageously done without losing any potentially important sound segments—that is, the late packets are advantageously handled in such a way that phoneme segments are preserved thereby maintaining high voice quality.

In particular, illustrative embodiments of the present invention take advantage of the fact that a voice frame is usually decoded in several sub-frames—typically two or three. Thus, in accordance with one illustrative embodiment of the present invention, one sub-frame from each frame is skipped, while advantageously maintaining the phase relationship between successive frames. For example, if a frame is decoded in two sub-frames, skipping one sub-frame of a given frame results in effectively playing out the speech for a time period equal to half of the original time duration (e.g., 10 milliseconds for a 20 millisecond packet). (Note that this is not the same as playing the entire packet at twice the speed, which would severely distort the pitch of the speech.) If, on the other hand, a frame is decoded in three sub-frames, skipping one sub-frame of a given frame is effectively playing out the speech for only two-thirds of the time scale. Thus, when a single frame is late, the decoder is advantageously synchronized with the encoder within at most three frames (or, alternately, at a subsequent silence segment).

BRIEF DESCRIPTION OF THE DRAWINGS

FIG. 2(*a*) shows a timing sequence diagram for an encoder and a decoder in a case where all packets arrive in time; FIG. 2(*b*) shows a timing sequence diagram for an encoder and a decoder in a case where a packet is missing and not received late; FIG. 2(*c*) shows a timing sequence diagram for an encoder and a prior art decoder in a case where a packet is received late; FIG. 2(*d*) shows a timing sequence diagram for an encoder and an illustrative decoder in accordance with an illustrative embodiment of the present invention in the case where a packet is received late; FIG. 2(*e*) shows a timing sequence diagram for an encoder and an illustrative decoder in accordance with an illustrative embodiment of the present invention in a case where several consecutive packets are received late, and some, but not all, of the late packets are played out; and FIG. 2(*f*) shows a timing sequence diagram for an encoder and an illustrative decoder in accordance with an illustrative embodiment of the present invention in a case where two consecutive packets are late and where the next one is missing.

DETAILED DESCRIPTION OF THE ILLUSTRATIVE EMBODIMENTS

Figure 1:
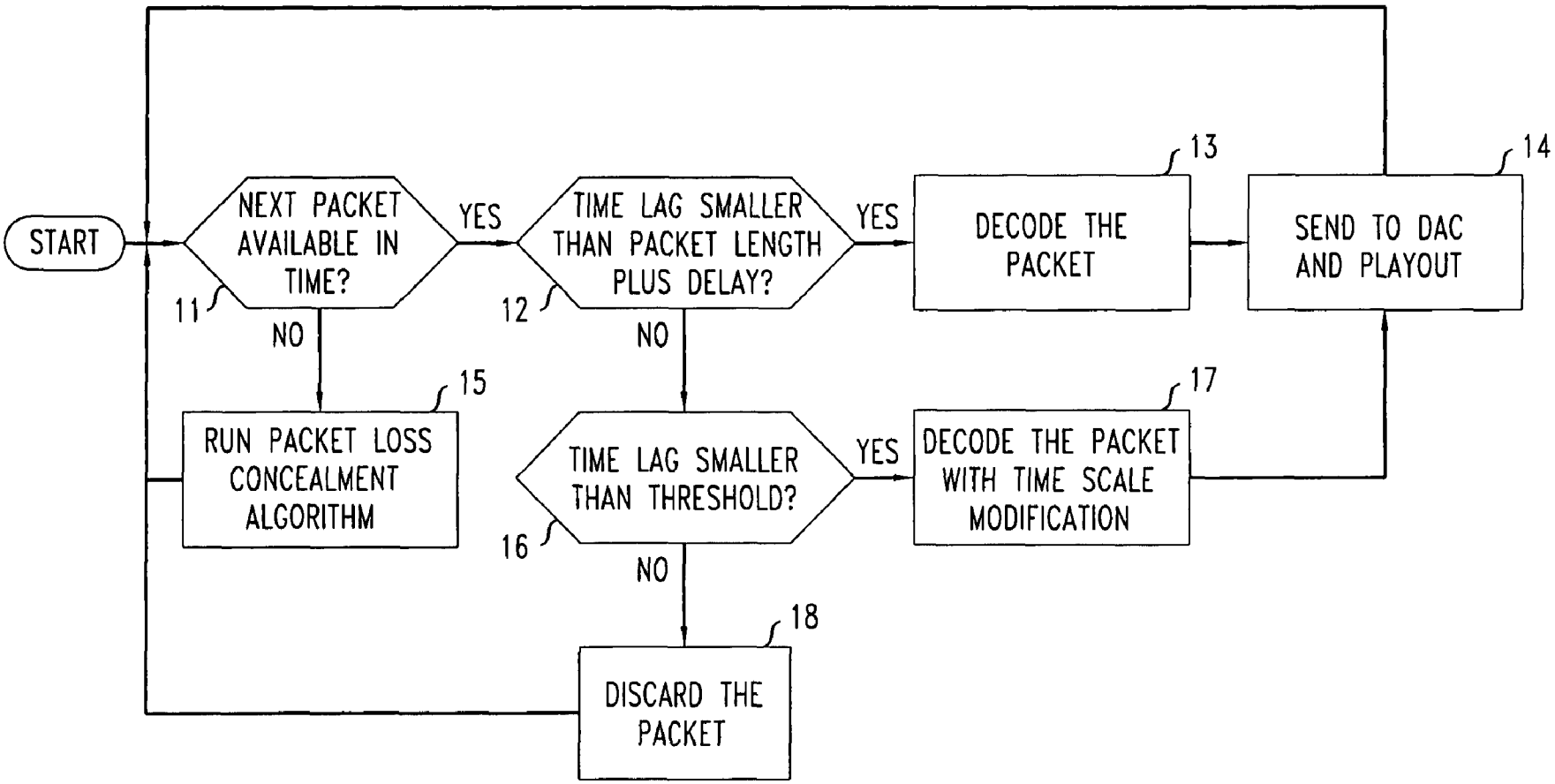
FIG. 1 shows a block diagram of a method for enhancing voice intelligibility in Voice-over-IP network applications in the presence of late arriving packets in accordance with one illustrative embodiment of the present invention.

FIG. 1 shows a block diagram of a method for enhancing voice intelligibility in Voice-over-IP network applications in the presence of late arriving packets in accordance with one illustrative embodiment of the present invention. The decoder of the illustrative embodiment of FIG. 1 checks the jitter buffer periodically—for example, every 20 msec (milliseconds) assuming that a packet contains 20 msec worth of speech material. In particular, decision box 11 determines if the next packet is available in time. If it is, decision box 12 determines whether the time lag is smaller than the packet length plus the end-to-end delay. If it is, flow proceeds to block 13 which decodes the packet and block 14 which sends the decoded data to the DAC (Digital to Analog Converter) and to playout. Thus, if packets keep arriving in time, blocks 13 and 14 of the figure are repeatedly processed. The time lag between the encoder time stamp and the decoder time stamp may be advantageously set to be smaller than the packet length (20 msec in this example) plus the end-to-end delay.

Suppose now that packet n is not available in time for playout (e.g., the jitter buffer is empty) because packet n is either lost or late, as determined by decision box 11. The illustrative algorithm of FIG. 1 then runs the packet loss concealment algorithm (block 15) in order to provide replacement speech material for the unavailable speech. Then, if the next packet (i.e., packet n+1) also misses its playout time, the decoder will continue to use the packet loss concealment algorithm (block 15) until packets arrive. Note that during packet loss concealment, the time stamp of the speech material being played out at the decoder advantageously does not proceed compared to the time stamp of the encoder. Thus, when packets are lost or late, there is a time lag between the encoder and the decoder. Whenever a new packet arrives, the decoder checks the time stamps and then, in accordance with the principles of the invention, advantageously attempts to re-synchronize with the encoder by shortening the playback duration of the packet, in an attempt to keep the end-to-end delay constant. Specifically, decision box 16 determines if the time lag is smaller than a predetermined threshold (see below), and if so, time scale modification (as shown in block 17 of the figure) is performed in accordance with the principles of the present invention. If the time lag is larger than the threshold, the packet is skipped entirely (as shown in block 18 of the figure).

More specifically, if there are packets available in the jitter buffer when the decoder checks at the end of a current cycle, it advantageously retrieves one packet and determines whether the new packet is the packet n that has arrived late or if it is packet n+1, having skipped the packet n. If the new packet is in fact packet n+1, it may be assumed that packet n is probably lost, and therefore it decodes the packet n+1. If, on the other hand, the new packet is the late packet n, this late packet n is also decoded and played before it proceeds to the next packet n+1. (Note that in this scenario in prior art systems, the late packet n is discarded and the decoder proceeds to the next packet n+1 in order to keep up with the encoder—that is, the packet n is never played out. In this manner, the decoder and the encoder remain synchronized, but the speech material in packet n is discarded.)

In order to synchronize decoder with the encoder, however, the late packet n is advantageously played over a shorter time scale than the original packet length in accordance with the principles of the present invention. Moreover, additional, future frames may also be played over a shorter time scale as well (as needed to synchronize the decoder). In particular, the number of such packets that will be shortened depends on the time scale modification factor which is chosen. For example, if frame n arrived late and it was played at a time scale of two-thirds of its normal duration, then frames n+1 and n+2 are also advantageously played at a time scale of two-thirds of their normal durations in order to synchronize with the encoder after packet n+2 has been played. (In accordance with other illustrative embodiments of the present invention, if there continue to be late packets, and the delay budget allows it, a decision may be made to allow the packets to play for their regular time course, effectively allowing for more jitter to be accommodated.)

Clearly, the decoder cannot wait for frames indefinitely. Thus, a predetermined time limit is advantageously provided in order to determine whether a packet is late or should be deemed to be actually lost. (See the discussion of the time threshold used in decision box 16 above.) Illustratively, this predetermined time limit may be advantageously set to be equal to the length of either 2 or 3 packets (which is typically 40-60 milliseconds). Then, any packets that arrive later than this threshold (i.e., the time limit) may, in accordance with one illustrative embodiment of the present invention, be used to update the decoder's internal state, but these packets are otherwise advantageously discarded (as shown in block 18 of the figure) without being played out. (In other words, if these "too late" packets are in fact used to update the decoder's internal state, any decoder output therefrom is advantageously discarded.)

Figure 2:
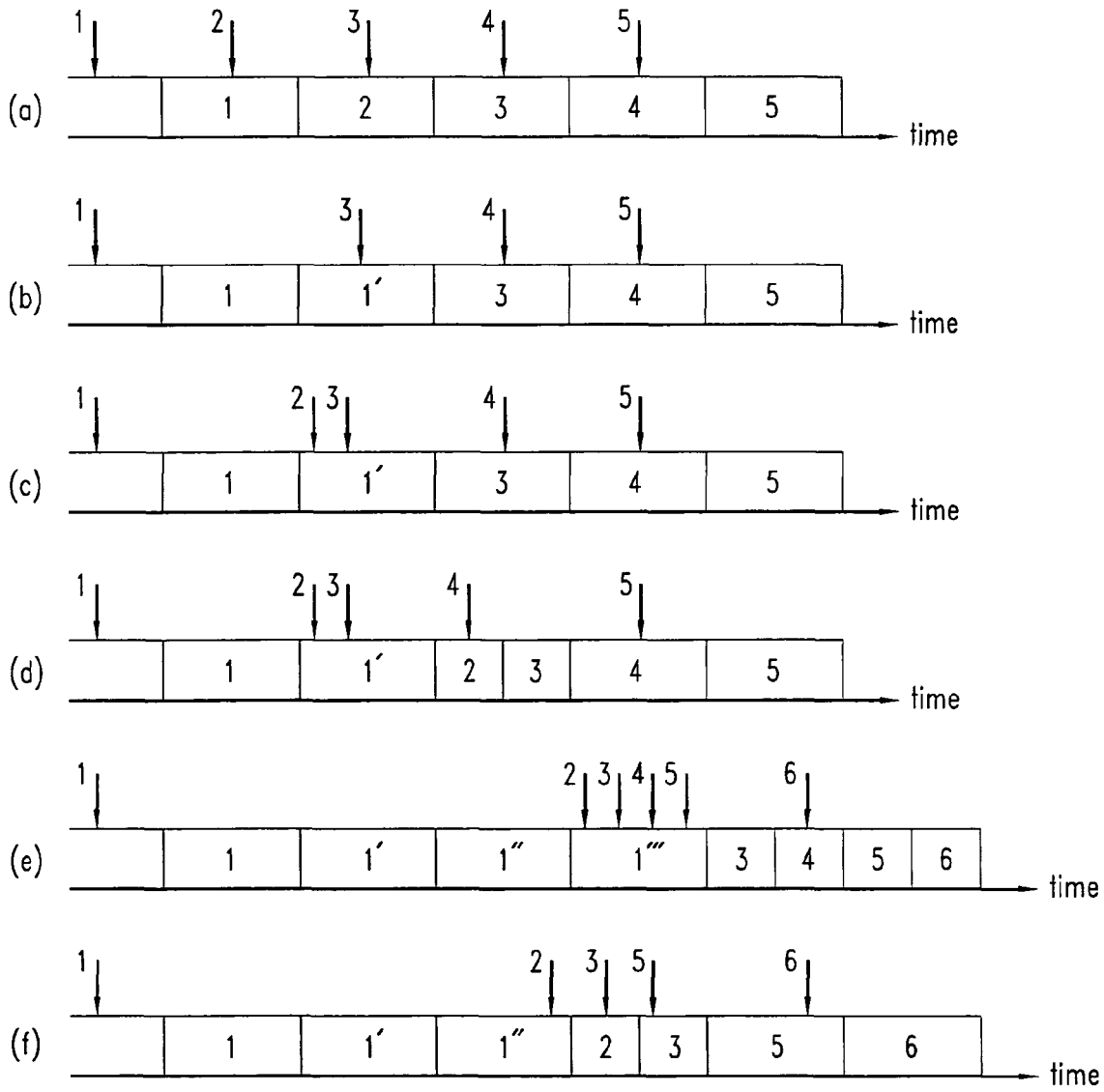
FIG. 2 shows a set of diagrams illustrating example timing sequence relationships between a speech encoder and certain speech decoders.

FIG. 2 shows a set of diagrams illustrating example timing sequence relationships between a speech encoder and certain speech decoders. The arrows in the diagrams show the points in time when packets arrive at the decoder. And the numbers above the arrows represent the frame sequence. Note that due to the network jitter, intervals between arrows are not typically even.

FIG. 2(*a*) shows a timing sequence diagram for an encoder and a decoder in a case where all packets arrive in time. In particular, the figure shows five packets, all of which arrive in time with small jitter. All packets are decoded and played out normally. This timing sequence diagram applies to both a prior art decoder and to a decoder in accordance with an illustrative embodiment of the present invention.

FIG. 2(*b*) shows a timing sequence diagram for an encoder and a decoder in a case where a packet is missing and not received late. In particular, the figure shows that when a packet is lost (packet 2), a packet loss concealment algorithm fills the gap (represented as 1' in the figure) by generating a replacement packet based on the previous packet (i.e., packet 1), skips packet 2, and then continues with packet 3 (which has been received in time). Again, this timing sequence diagram applies to both a prior art decoder and to a decoder in accordance with an illustrative embodiment of the present invention.

FIG. 2(*c*) shows a timing sequence diagram for an encoder and a prior art decoder in a case where a packet is received late. In particular, for a prior art decoder, when a packet experiences excessive jitter and misses its sync (as is the case for packet 2 in the figure), a packet loss concealment algorithm again fills the gap (as in FIG. 2(*b*)). However, the late packet 2 gets dropped completely, or else it is used only for updating the internal state of the decoder. The prior art decoder then continues with packet 3 (which has been received in time). In either case, however, packet 2 never gets to be played out.

FIG. 2(*d*) shows a timing sequence diagram for an encoder and an illustrative decoder in accordance with an illustrative embodiment of the present invention in the case where a packet is received late. That is, in accordance with an illustrative decoder of the present invention, both the late packet 2 and (timely) packet 3 are advantageously played out, but with a shorter than normal duration, in order that the decoder is synchronized with the encoder (in this case, at packet 4) while not losing any sound that may be critical for intelligibility of the speech. Specifically, in FIG. 2(*d*), the time scale modified packets (i.e., packets 2 and 3) are illustratively played out with half the time duration, so that synchronization is achieved for packet 4.

FIG. 2(*e*) shows a timing sequence diagram for an encoder and an illustrative decoder in accordance with an illustrative embodiment of the present invention in a case where several consecutive packets are received late, and some, but not all, of the late packets are played out. As described above, a maximum timeout threshold is advantageously set so that the decoder does not wait indefinitely for late packets. FIG. 2(*e*) shows an example where the threshold is set to a time equal to the length of three packets. In the figure, note that the late packet 2 is skipped even though it eventually arrived, since it did not arrive until after the time threshold had passed. In addition, note that three consecutive replacement packets are generated—packets 1', 1" and 1'"—before the decoder has a received packet for use. In particular, the figure shows packets 3, 4, 5 and 6, each being time scale modified, again illustratively to half of their normal durations.

And finally, FIG. 2(*f*) shows a timing sequence diagram for an encoder and an illustrative decoder in accordance with an illustrative embodiment of the present invention in a case where two consecutive packets are late and where the next one is missing. (In particular, packets 2 and 3 are late while packet is 4 is missing.) Note that even though packet 4 is lost, the decoder is already in sync with the encoder at packet 5 due to the late packets. Therefore, there is no need for packet loss concealment for packet 4, and the illustrative decoder of the present invention advantageously continues with a playout of packet 5.

There are several methods for time scale modification of speech signals which may be used in accordance with various illustrative embodiments of the present invention. In accordance with one illustrative embodiment of the invention, the well-known pitch synchronous overlap add (PSOLA) method may be used. This method provides a technique with high resultant voice quality, and it is the most popular signal processing method used in text-to-speech synthesis applications in which time scale modification is employed.

In accordance with other illustrative embodiments of the present invention, a simpler alternative (as compared to the use of the PSOLA method) is to merely control the number of sub-frames decoded and played at the decoder. In typical voice codecs (encoder/decoder systems), a voice frame is decoded into either two sub-frames (e.g., in the well known G.729 voice coding standard) or three sub-frames (e.g., in the well known EVRC coding standard). If a frame is decoded into two sub-frames, skipping one sub-frame is effectively the same as playing out the speech for half of the interval. In this case, when a single frame is late, the decoder is synchronized with the encoder after decoding two frames including the late one. If, on the other hand, a frame is decoded into three sub-frames, skipping one sub-frame (out of three) is equivalent to playing it out at two-thirds of its normal time scale. In this case, when a single frame is late, the decoder is synchronized with the encoder after decoding three frames including the late one.

Addendum to the Detailed Description

It should be noted that all of the preceding discussion merely illustrates the general principles of the invention. It will be appreciated that those skilled in the art will be able to devise various other arrangements, which, although not explicitly described or shown herein, embody the principles of the invention, and are included within its spirit and scope. Furthermore, all examples and conditional language recited herein are principally intended expressly to be only for pedagogical purposes to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. It is also intended that such equivalents include both currently known equivalents as well as equivalents developed in the future—i.e., any elements developed that perform the same function, regardless of structure.

Thus, for example, it will be appreciated by those skilled in the art that any flow charts, flow diagrams, state transition diagrams, pseudocode, and the like represent various processes which may be substantially represented in computer readable medium and so executed by a computer or processor, whether or not such computer or processor is explicitly shown. Thus, the blocks shown, for example, in such flowcharts may be understood as potentially representing physical elements, which may, for example, be expressed in the instant claims as means for specifying particular functions such as are described in the flowchart blocks. Moreover, such flowchart blocks may also be understood as representing physical signals or stored physical data, which may, for example, be comprised in such aforementioned computer readable medium such as disc or semiconductor storage devices.

We claim:

1. A method for playing out speech received as a sequence of encoded speech packets over a packet-based communications network, the method comprising the steps of:

determining that a given speech packet has not been received prior to a time when said given speech packet is to be decoded for playout;

replacing said given speech packet with replacement speech data with use of a packet loss concealment technique;

playing out said replacement speech data in place of said given speech packet;

receiving said given speech packet at a time subsequent to said playing out of said replacement speech data;

modifying said given speech packet which has been received and replaced to generate a time scale modified version thereof, said time scale modified version of said given speech packet comprising speech having a reduced time length relative to said given speech packet; and playing out said time scale modified version of said given speech packet after said replacement speech data which replaced said given speech packet has been played out.

2. The method of claim 1 wherein said step of determining that said given speech packet has not been received prior to the time when said given speech packet is to be decoded for playout comprises determining that a jitter buffer is empty at said time when said given speech packet is to be decoded for playout.

3. The method of claim 1 where said replacement speech data is generated based on a previous speech packet in said sequence of encoded speech packets.

4. The method of claim 3 wherein said packet loss concealment technique comprises replacing said given speech packet with a duplicate of an immediately previous speech packet in said sequence of encoded speech packets.

5. The method of claim 1 wherein said time scale modified version of said given speech packet is generated from said given speech packet with use of a pitch synchronous overlap add (PSOLA) technique.

6. The method of claim 1 wherein said given speech packet comprises a speech frame consisting of a plurality of sub-frames, and wherein said time scale modified version of said given speech packet is generated from said given speech packet by eliminating one or more of said plurality of sub-frames therefrom.

7. The method of claim 1 further comprising the step of determining that said given speech packet which has been received at a time subsequent to said playing out of said replacement speech data has also been received at a time prior to a predetermined time limit after said time when said given speech packet was to be decoded for playout.

8. The method of claim 1 further comprising the steps of:

receiving one or more speech packets subsequent to said given speech packet in said sequence of speech packets;

modifying a number of said subsequent speech packets to generate a corresponding time scale modified version thereof, said time scale modified version of each of said number of subsequent speech packets comprising speech having a reduced time length relative to said corresponding subsequent speech packet; and playing out each of said number of said time scale modified versions of said subsequent speech packets after said time scale modified version of said given speech packet has been played out.

9. The method of claim 8 wherein said number has a fixed value such that after said number of said time scale modified versions of said subsequent speech packets have been played out, said sequence of encoded speech packets as received are synchronized with said playing out thereof.

10. The method of claim 1 wherein the speech received as a sequence of encoded speech packets over a packet-based communications network comprises Voice-over-IP.

11. An apparatus for playing out speech received as a sequence of encoded speech packets over a packet-based communications network, the apparatus comprising:

a processor and a storage device having code stored thereon, wherein the code, when executed by the processor, causes the processor to:

determine that a given speech packet has not been received prior to a time when said given speech packet is to be decoded for playout;

replace said given speech packet with replacement speech data with use of a packet loss concealment technique;

play out said replacement speech data in place of said given speech packet;

receive said given speech packet at a time subsequent to said playing out of said replacement speech data;

modify said given speech packet which has been received and replaced to generate a time scale modified version thereof, said time scale modified version of said given speech packet comprising speech having a reduced time length relative to said given speech packet; and play out said time scale modified version of said given speech packet after said replacement speech data which replaced said given speech packet has been played out.

12. The apparatus of claim 11 wherein said determining that said given speech packet has not been received prior to the time when said given speech packet is to be decoded for playout comprises determining that a jitter buffer is empty at said time when said given speech packet is to be decoded for playout.

13. The apparatus of claim 11 where said replacement speech data is generated based on a previous speech packet in said sequence of encoded speech packets.

14. The apparatus of claim 13 wherein said packet loss concealment technique comprises replacing said given speech packet with a duplicate of an immediately previous speech packet in said sequence of encoded speech packets.

15. The apparatus of claim 11 wherein said time scale modified version of said given speech packet is generated from said given speech packet with use of a pitch synchronous overlap add (PSOLA) technique.

16. The apparatus of claim 11 wherein said given speech packet comprises a speech frame consisting of a plurality of sub-frames, and wherein said time scale modified version of said given speech packet is generated from said given speech packet by eliminating one or more of said plurality of sub-frames therefrom.

17. The apparatus of claim 11 wherein said processor is further adapted to determine that said given speech packet which has been received at a time subsequent to said playing out of said replacement speech data has also been received at a time prior to a predetermined time limit after said time when said given speech packet was to be decoded for playout.

18. The apparatus of claim 11 wherein said processor is further adapted to:

receive one or more speech packets subsequent to said given speech packet in said sequence of speech packets;

modify a number of said subsequent speech packets to generate a corresponding time scale modified version thereof, said time scale modified version of each of said number of subsequent speech packets comprising speech having a reduced time length relative to said corresponding subsequent speech packet; and play out each of said number of said time scale modified versions of said subsequent speech packets after said time scale modified version of said given speech packet has been played out.

19. The apparatus of claim 18 wherein said number has a fixed value such that after said number of said time scale modified versions of said subsequent speech packets have been played out, said sequence of encoded speech packets as received are synchronized with said playing out thereof.

20. The apparatus of claim 11 wherein the speech received as a sequence of encoded speech packets over a packet-based communications network comprises Voice-over-IP.

* * * * *